United States Patent [19]

Colin

[11] 4,446,808

[45] May 8, 1984

[54] BARGE-TUG CONNECTION APPARATUS

[75] Inventor: Jean P. Colin, Metairie, La.

[73] Assignee: Ateliers et Chantiers de Bretagne acb, Nantes, France

[21] Appl. No.: 282,810

[22] Filed: Jul. 13, 1981

Related U.S. Application Data

[63] Continuation-in-part of Ser. No. 116,616, Jan. 29, 1980, Pat. No. 4,347,801.

[51] Int. Cl.[3] ..... B63B 21/60

[52] U.S. Cl. ..... 114/248; 114/249

[58] Field of Search ..... 114/248, 249; 92/40; 403/5

[56] References Cited

U.S. PATENT DOCUMENTS

| | | | |
|---|---|---|---|
| 3,362,372 | 1/1968 | Peterson | 114/248 |
| 3,446,173 | 5/1969 | Ohcho et al. | 114/248 |
| 3,763,773 | 10/1973 | Clay | 92/40 |
| 3,922,993 | 12/1975 | Bludworth | 114/248 |
| 4,148,270 | 10/1979 | Bludworth | 114/248 |

*Primary Examiner*—Sherman D. Basinger
*Attorney, Agent, or Firm*—Charles C. Garvey

[57] ABSTRACT

An improved barge and tug connection apparatus comprises a barge having a V-notched portion for receiving a tug into the V-notch. A tug for pushing the barge is disposed during operation within the notch allowing the tug to pitch and heave in the notch relative to the barge responsive to wave action. An articulated bow fender attached normally to the bow of the tug and disposed during operation between the bow of the tug and a portion of the notch of the barge longitudinally spaces the barge from the bow of the tug. The articulated bow fender maintains a substantially constant horizontal spacing of the barge with respect to the tug in a longitudinal direction while allowing both the tug along its entire length to pitch and heave with respect to the barge responsive to wave action. A plurality of side fenders affixed to the tug hull bear outwardly to abut the barge inside the V-notch, the side fenders are positioned to bear and slide against the barge on a provided bearing surface responsive to lateral and vertical relative movement between the tug and barge. The side fenders feature hydraulic pads which are inflatable to a desired pressure and normally absorb lateral forces between the tug and barge. The inflatability of the pads affords lateral movement to the side fender wear surfaces. Thus, the pads can be deflated, providing a clearance between the tug and barge during placement-/removal of the tug with respect to the notch. When the tug is fully in the notch, the hydraulic pads are inflated to a desired predetermined pressure and the clearance between tug and barge bearing surfaces is cancelled. Absent pressurization, the pads collapse responsive to urging by provided return springs. The pads are preferably of a steel reinforced rubber construction.

21 Claims, 15 Drawing Figures

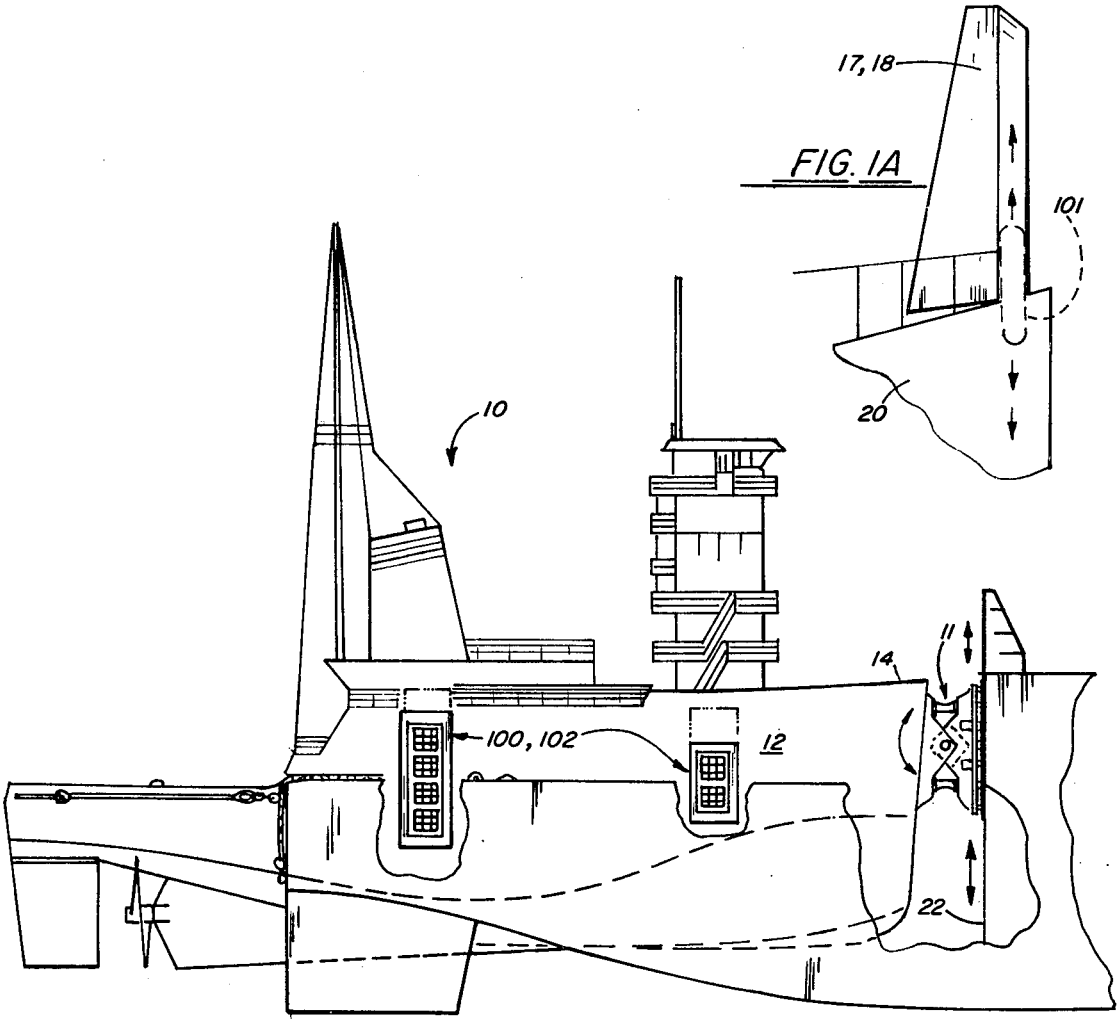
FIG. 1A
FIG. 1
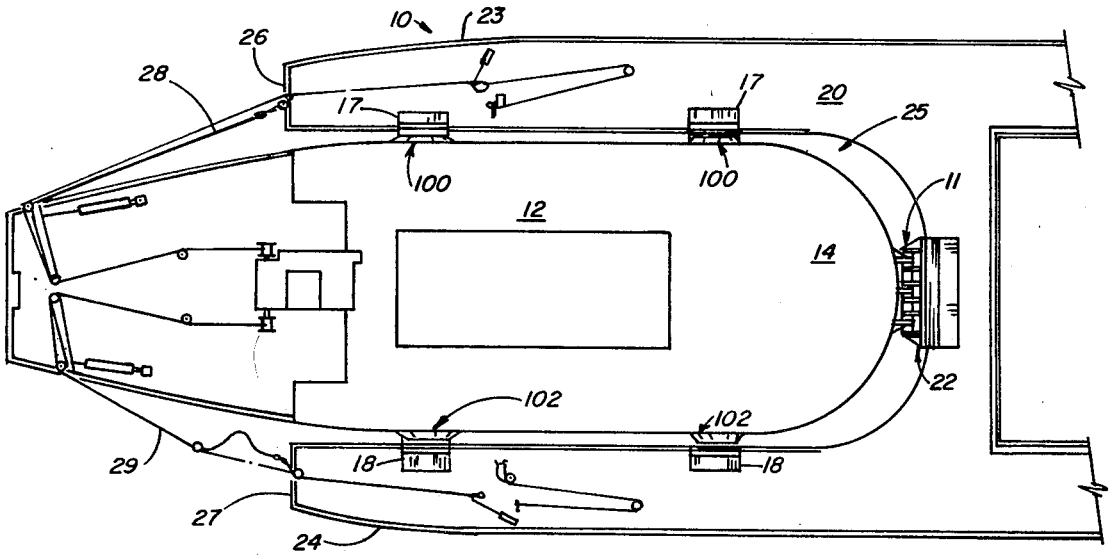
FIG. 2

BARGE-TUG CONNECTION APPARATUS

REFERENCE TO RELATED APPLICATION

This is a continuation-in-part of copending U.S. patent application Ser. No. 116,616, filed Jan. 29, 1980, and entitled "Barge and Tug Connection System", now U.S. Pat. No. 4,347,801.

BACKGROUND OF THE INVENTION

1. Field of the Invention

The present invention relates to connection systems for barge-tug connections in which a tug pushes a notched barge allowing relative vertical movement therebetween. More particularly, the present invention relates to a fender system for use between the barge and the tug to buffer forces therebetween, and to a connection and tensioning coupling device for the "pushing lines" which connect notched barges and tugs together preventing separation in adverse sea conditions while allowing relative movement between the tug and the barge, and further allowing easy, quick release of the pushing lines in emergencies without human intervention on deck.

2. General Background

It is known in the marine art to secure a tug in the notch of a V-notched barge by using pushing lines.

It is also known to form connections both fixed and moving between the tug and the barge at the tug bow.

When connecting a tug and V-notched barge, pushing lines are usually firstly connected. One end of a heavy cable, generally a wire rope, is secured with a shackle to the transom of the barge on each side. The other end of this cable, called the pushing line, runs over a large sheave pinned on the aft deck of the tug, close to the bulwark, and is then secured either to the deck of the ship or to the towing winch, sometimes through some kind of device giving some elasticity to the assembly.

Generally all systems are built on these present principles and differ only by their components. Most of these prior art systems have the same drawbacks. The pushing lines at sea are taut and slack alternatively, due to relative motions of the tug and barge, and snap by snatching when the sea deteriorates. The handling of those lines is very clumsy and there is generally no safe emergency release system.

Rubber tires, rigid connections, and complex "pinching" arrangements are used to space the barge-tug longitudinally, usually at the bow of the tug. Those systems of the prior art, although in use for many years, have not been greatly improved since the tugs were pushing only in relatively good weather.

The sizes of tugs and barges are now increasing sensibly as well as the necessity to keep on pushing in adverse conditions. Some recent technological improvements on the fender system of the tug allow the tug to stay in the barge up to fifteen (15) foot seas and there is a demand for improved pushing lines. An increase in the size of the actual system becomes a problem in that large systems are impossible to handle by the crew members and too expensive.

U.S. Pat. No. 4,168,672 issued to Fletcher discloses an apparatus for transmission of thrust from the bow of a tug secured in the bottomless recessed well of a barge. Transmitting means is mounted to the bow of the tug to a retaining means which is mounted to the stern of the barge and an ajustable coupling means is mounted to the tug and barge proximity of the thrust transmitting means and complementary retaining means. The apparatus may include calbes for connecting the tug to the barge for maintaining longitudinal alignment and a number of resilient bumpers mounted to the bow of the tug to absorb collision shock between the two vessels.

U.S. Pat. No. 4,148,270 issued to Bludworth discloses an apparatus for releasably coupling an articulated ship, particularly a tug-barge combination, by use of a coupling arrangement permitting both rigid and flexible interconnection. One vessel is provided with opposed bearing surfaces which are secured to the gripping members of the second vessel. The barge partially accepts the tug in a bottomless notch in its stern.

U.S. Pat. No. 4,041,888 issued to Hooper, et al, discloses a thrust transmitting means for a tug and barge without mechanical coupling. A deep bottomless V-notch is provided at the stern of the barge to receive the bow of the tug. The bow of the tug has a thrust exerting member which is adapted to mate thrust receiving means on the barge at different relative drafts of the two vessels. Automatic lubrication is provided to the mating system.

A prior U.S. Pat. No. 4,031,843 issued to applicant herein, Jean Paul Colin, discloses a tug-barge interconnection where the barge has a longitudinal groove at the stern of the barge having an inverted T-form in transverse cross-section which is adapted to receive the tug, which has a rigid thrust transmitting member attached thereto. The vessels are interconnected by hydraulic compression members combined with pressure accumulators. Inflatable cushions are interposed between the barge and tug surfaces.

U.S. Pat. No. 4,023,519 issued to Harms discloses an apparatus for coupling a tug in a barge. The apparatus comprises coupling means in the stern of the barge and at the bow of the tug to allow relative movement of the vessels about a vertical axis. Elongated flexible connectors are provided between the vessels, one on each side. The tug can act as a rudder for steering the barge.

U.S. Pat. No. 4,026,234 issued to Zbilut, et al, discloses a device for coupling a barge to a tug for sea transportation, the barge having a stern portion with a bottomless, V-notch or nest and the tug having a bow to mate with such nest. The coupling device includes a system of guiding rollers which are mounted on the wings of the nest of the barge including shock absorbers and hydraulic power devices. Cables are passed over the rollers and fixed to the deck of the tug. The device has self-adjusting qualities securing both constant position of the tug relative to the barge and a constant pressure of the tug against the barge both in pushing.

U.S. Pat. No. 4,013,032 issued to Bludworth discloses an articulated ship comprising a cargo vessel and a powered vessel. The cargo vessel has a bottomless, V-notch at its stern end for receiving a portion of the powered vessel. Three individual locking means are provided for rigidly coupling the two vessels together for instantaneous engagement and disengagement. The locking means permit a multiplicity of relative draft engagements of the two vessels.

U.S. Pat. No. 4,000,714 issued to Jean Paul Colin (applicant herein), discloses a system for interconnecting barges and tugs in which the barge has a longitudinal grooved recess which is an inverted T-section in cross-section into which the bow of the tug can adapt itself with clearance when the tug and barge are brought together. They are secured to each other by thrust transmitting and receiving members.

U.S. Pat. No. 3,962,983 issued to Ono discloses a connecting structure for an oceangoing push barge. The bow of a powered pusher-boat is connected to the stern of a powerless barge in a recessed or notched, bottomless portion formed at the stern of the barge. Projecting connecting pins are provided at positions near the center part of and on both sides of the bow of the pusher-boat. These are inserted in connecting pin receiving ports formed at corresponding positions in the recess of the barge to unify the vessels into a single navigable vessel.

U.S. Pat. No. 3,954,078 issued to Garcia discloses a method of connecting adjacent units of a barge two with interlocking connectors between which unit ends deflated cushions are placed in expandable enclosures for preventing friction between the cushions and the tow units when they are later inflated.

U.S. Pat. No. 3,949,699 issued to Heese discloses a method and apparatus for connecting two vessels such as a tug and barge to form a composite vessel. It uses a hydraulically powered apparatus to extend a shaft from the vessel in it on toward the other vessel which has an apparatus to capture the extended shaft.

U.S. Pat. No. 3,935,831 issued to Yamaguchi discloses an apparatus for connecting a tug and a barge in which the bow of the tug is received in a bottomless, notched stern portion of the barge. Movable connecting pins are mounted on both sides of the bow of the tug and are inserted into vertical channels formed within the notch of the barge.

U.S. Pat. No. 3,922,993 issued to Bludworth discloses a barge with a bottomless notch in its stern for receiving the bow of a tug with bumpers therebetween to prevent relative yawing of the two vessels. A coupling apparatus is provided to permit vertical pivoting of the two vessels about the point of couplings.

U.S. Pat. No. 3,910,219 issued to Ono discloses a connecting structure for tugs and barges wherein the stern of the barge is notched and bottomless receiving the bow of a tug. The front and sides of the portion of the tug which is received into the notch of the barge are provided with connecting pins protruding from the tug which are accepted in vertical receiving ports in the notch of the stern.

U.S. Pat. No. 3,892,196 issued to Swoboda discloses a tug-barge connecting system wherein hook-shaped latching members are provided on both the tug and barge for coupling the tug to the barge.

U.S. Pat. No. 3,892,195 issued to Janssen discloses a tug-barge coupling system in which tension coupling elements are connected to the barge and extend along the barge laterally of the tug and being connected thereto.

U.S. Pat. No. 4,073,217 issued to Jean Paul Colin (applicant herein), discloses a hydraulically or pneumatically controlled device for locking a piston in the bore of its cylinder at any point of its stroke. It comprises a piston and mounted thereon fluid tight seals, a series of wedges, and annular jacks incorporated in the piston.

U.S. Pat. No. 4,072,122 to Balston discloses a hydropneumatic device which secures and releases a mooring or towing hawser to a vessel.

U.S. Pat. No. 4,048,941 issued to Legnos discloses a barge with a bottomless notched stern for receiving the bow of a tug for an integrated vessel capable of use on the high seas. The tug is formed to securedly fit into the notch of the barge to prevent lateral movement.

3. General Discussion of the Present Invention

The present invention solves the prior art problems and shortcomings by providing a barge-tug connection, tensioning, and hydraulic spacing apparatus which allows relative movement between the tug and the barge in adverse sea conditions with a snapping of the pushing line being prevented. Further, the system of the present invention provides a reduced stress on the aft deck of the tug, consequently reducing the price of the tug. The present invention further provides a fast, efficient and safe emergency release system which can be operated without personnel on deck. The present invention also provides an apparatus which facilitates easy connection of the pushing lines and avoids the handling during connection of the pushing apparatus by deckhands.

The present invention provides a barge and tug connection apparatus with a barge having a V-notched portion connecting to a tug, the tug allowed to pitch and heave within the barge notch. At least one elongated elastic pushing line having barge and tug end portions is provided, with connections being perfected at the respective end portions to the barge and to the tug. A pre-stressing member mounted in the preferred embodiment on the tug stretches the pushing line uniformly along its length between the tug and the barge, the pushing line being unidirectional and being entirely disposed during operation between the tug and the barge, at the end connection portions.

A quick release system allows quick disconnection in, for example, emergency situations.

An improved fender system provides a plurality of hydraulically actuated pads on the tug to transmit forces between the tug and barge, absorbing shock and preventing damage. The pads act as fenders positioned away from the tug and bear against towers on the barge having bearing surfaces receptive of the pads. An associated hydraulic system pressurizes the pads to a desired pressure with the pad wear surface, with the pads having an indexing spring assembly which registers the pad at a desired normal position absent pressurization or contact with the barge.

The pre-stressing member can be a powered lever movably attached to the tug aft deck (see FIGS. 4 and 6). The pushing line lever connection can be a hook and eyelet connection with the lever providing a hook and the pushing line having an eyelet. Other suitable temporary connections such as a claw/ball or removable pin could be used.

The quick release system in the preferred embodiment is a slot in the tug bulwark, with the lever moving through the slot effecting a disengagement with the larger eyelet, the eyelet being unable to push through the slot.

The lever could be powered, for example, hydraulically by using a hydraulic cylinder affixed to the lever and to the tug deck. An alternate embodiment provides a movable powered carriage with an outboard projecting hook (see FIG. 7), while still another embodiment provides the hook portion directly affixed to the hydraulically powered cylinder (see FIGS. 10 and 11).

An improved articulated bow fender maintains horizontal spacing of the tug-barge in a longitudinal direction. The bow fender provides a first generally vertical coupling plate affixed to the tug bow with a second coupling plate attached thereto in a movable fashion which allows relative movement between the plates.

The plates are preferably vertically disposed and are preferably connected by a "pinned" connection which allows pivoted relative movement. A plastic generally flat face-plate mounted on the second moving coupling plate bears against a provided flat surface of the barge. Both bearing surfaces are generally vertical and flat, and extending laterally a distance in the port-starboard lateral direction. Pressure applied by the pushing lines and the tug urge the tug and barge bearing surfaces together during operation. The plastic surface which can be provided, for example, on the second coupling plate lessens friction and wear between the tug and barge.

It is thus an object of the present invention to provide a V-notched barge and tug connection system allowing relative movement between the barge and tug even in heavy seas.

It is another object of the present invention to provide a v-notched barge and tug connection system which reduces stresses transmitted to the pushing rig.

Another object of the present invention is to provide an improved fender system for transmitting forces between the barge and tug responsive to relative movement therebetween.

Another object of the present invention is to provide a fender system for use between tug and V-notched barge towing arrangements wherein the side fenders have laterally movable fender surfaces which can be retracted for insertion or removal of the tug, and actuated to expand with the wear surface during operation being forced into pressured contact with the barge.

Another object of the present invention is to provide a resilient fender arrangement for V-notched barge and tug connections which absorbs shock between the tug and barge generated during operation.

Another object of the present invention is to provide a V-notched barge and tug connection system wherein the connection is safely made without direct human intervention in the vicinity of the stressed pushing lines.

Another object of the present invention is to provide a V-notched barge and tug connection system which is quickly, easily, and safely disengaged during, for example, emergency situations.

Still another object of the present invention is to provide a V-notched barge and tug connection system which eliminates the chance of pushing lines becoming slack during the pushing operation, even during excessive relative movement between the barge and tug as occurs in heavy seas.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a side elevational view of the preferred embodiment of the apparatus of the present invention;

FIG. 1A is a partial perspective view of a barge tower and bearing surface portion of the preferred embodiment of the apparatus of the present invention;

FIG. 2 is a top view of the preferred embodiment of the apparatus of the present invention;

DETAILED DESCRIPTION OF THE PREFERRED EMBODIMENT

Figure 3:
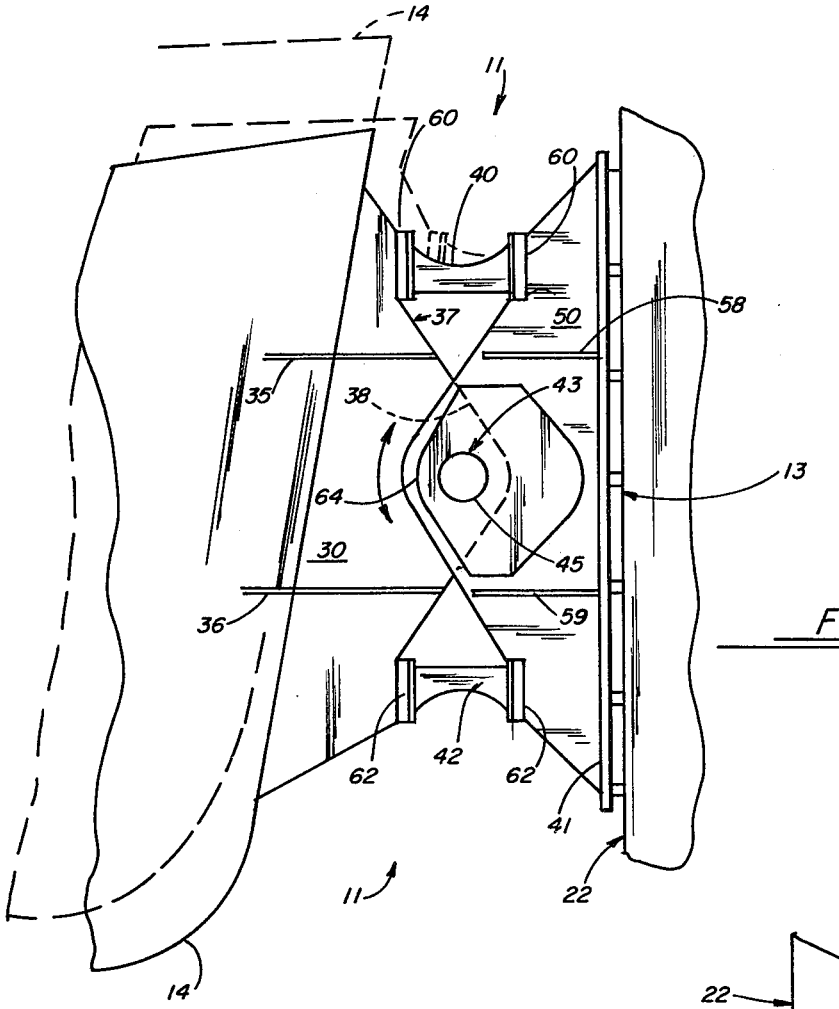
FIG. 3 is an enlarged partially broken elevational view of the bow fender portion of the preferred embodiment of the apparatus of the present invention.

FIGS. 1 and 2 illustrate the preferred embodiment of the apparatus of the present invention in elevation and in plan respectively and designated generally by the numeral 10. In FIG. 1 there can be seen a tug 12 having a bow 14 which supports as seen in FIG. 1, an articulated forward bow fender assembly 11 and side fender assemblies 100, 102, which during operation abut barge 20 at surface 22 which normally is a flattened surface as best seen in FIGS. 1 and 2. The connection allows tug 12 to pitch and heave with respect to barge 20. In such a case, bow fender assembly 11 provides a forwardmost surface 13 which abuts the surface 22 of barge 20 and slides upwardly and downwardly with respect thereto in a free, unattached manner, as will be described more fully hereinafter. Side fender assemblies 100, 102 are provided on the port and starboard sides respectively of tug 12 and face outwardly to barge 20 sliding thereagainst during operation.

Barge 20 would be a notch-type barge having a notch 25 defined by opposed port and starboard wings 23 and 24 respectively, extending aft of barge 20. As best seen in FIG. 2, tug 12 is partially received into notch 25.

As will be described more fully hereinafter, when tug 12 enters barge notch 25, side fenders 100, 102 which are hydraulically operated are deflated, thus leaving a desirable clearance of on the order of, for example, one inch between wear surfaces provided on the barge and on the respective side fender. When tug 12 is fully within notch 25, side fender assemblies are hydraulically inflated to a pre-determined desired pressure closing the clearance between the respective wear surfaces of barge 20 and tug 12. Subsequent deflation of the hydraulically operated side fenders 100, 102 allows for release of the tug.

A pair of pushing lines 28, 29 secure tug 12 into notch 25 by attaching generally at the transom 26 of wing 23 and at the transom 27 of wing 24. Each pushing line 28, 29 attaches to the stern portions of the tug 12 and to the transom 26, 27 of barge 20. The pushing lines 28, 29 are elastic. Each line 28, 29 has an eyelet at one end which attaches to the tug at a releasable hook mounted on the tug stern, and the other end of each line 28, 29 is attached to the barge transom. The hook is powered to move aft to prestress and preload the pushing lines for operation. To disengage each pushing line, the hook moves forward which disengages the hook and eyelet. This pushing line system is more particularly described in my prior filed, copending U.S. patent application, Ser. No. 116,616 which was filed on Jan. 29, 1980 and now U.S. Pat. No. 4,347,801, that application being incorporated herein by reference.

Figure 7:
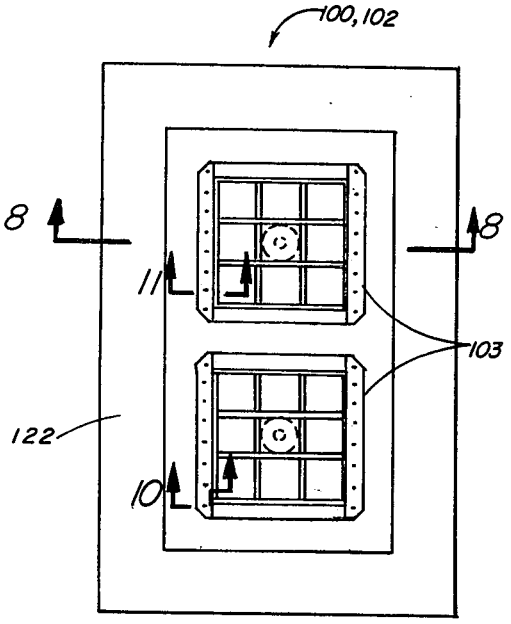
FIG. 7 is an elevational view of the inflatable pad side fender portion of the preferred embodiment of the apparatus of the present invention.
Figure 8:
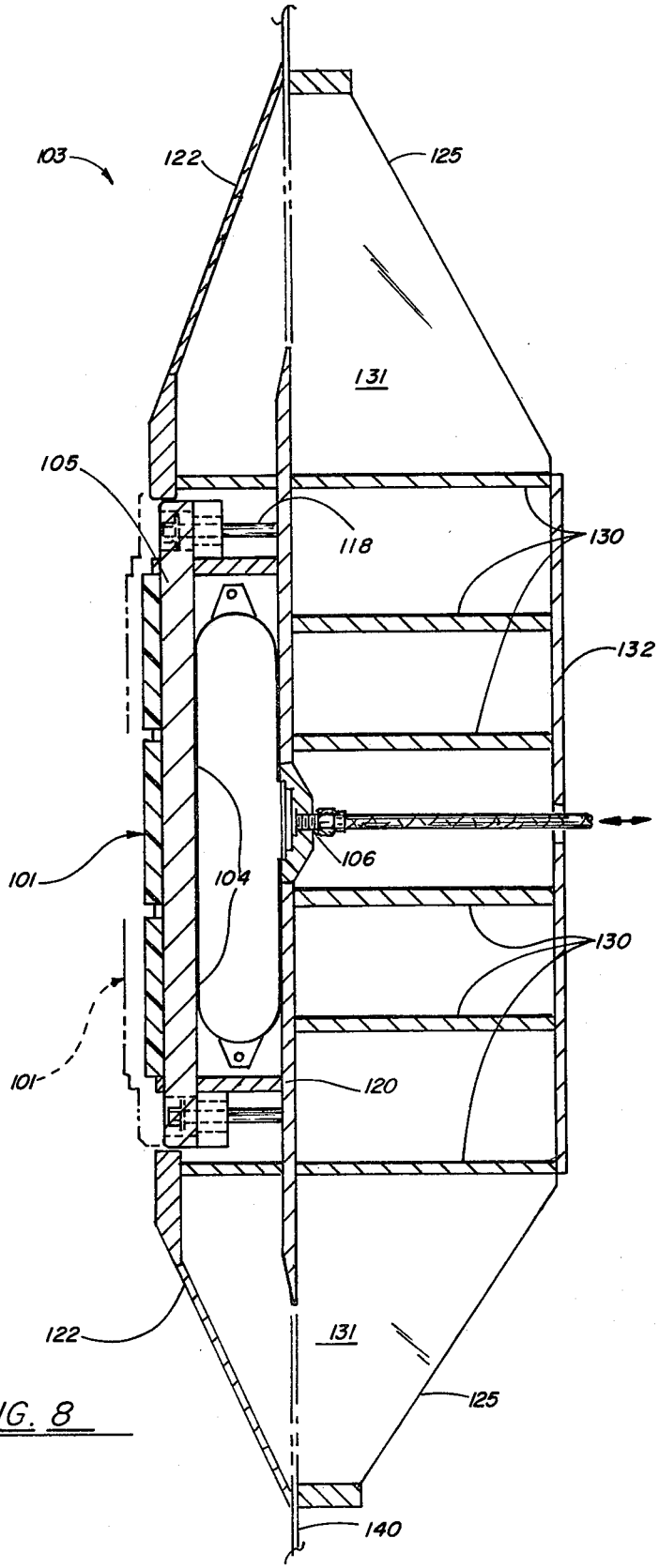
FIG. 8 is a sectional view taken along lines 8—8 of FIG. 7.
Figure 9:
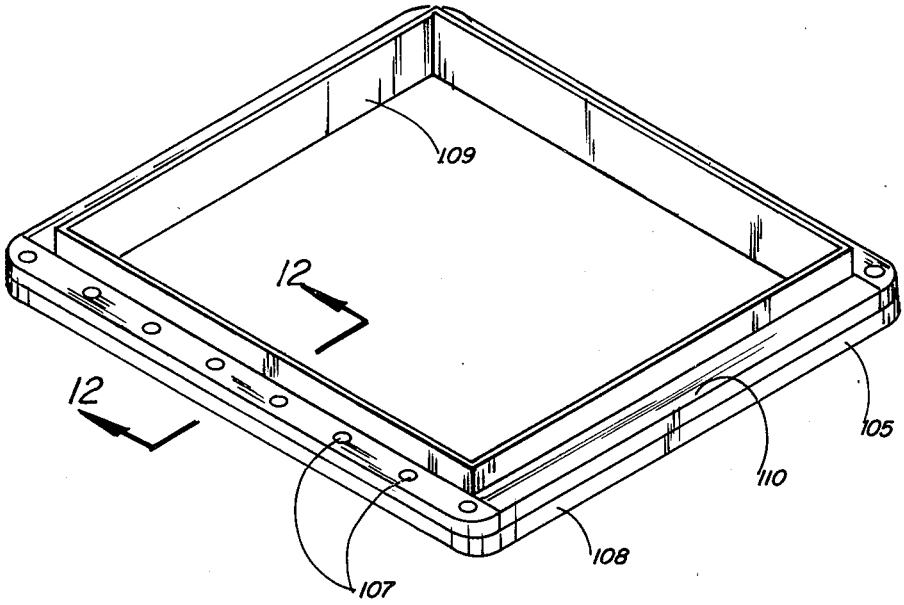
FIG. 9 is a perspective view of the inflatable pad side fender of FIGS. 7–8 showing the hydraulic pad cover portion thereof.
Figure 12:
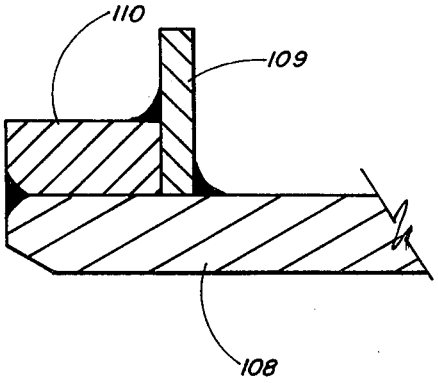
FIG. 12 is a sectional view taken along lines 12—12 of FIG. 9.
Figure 13:
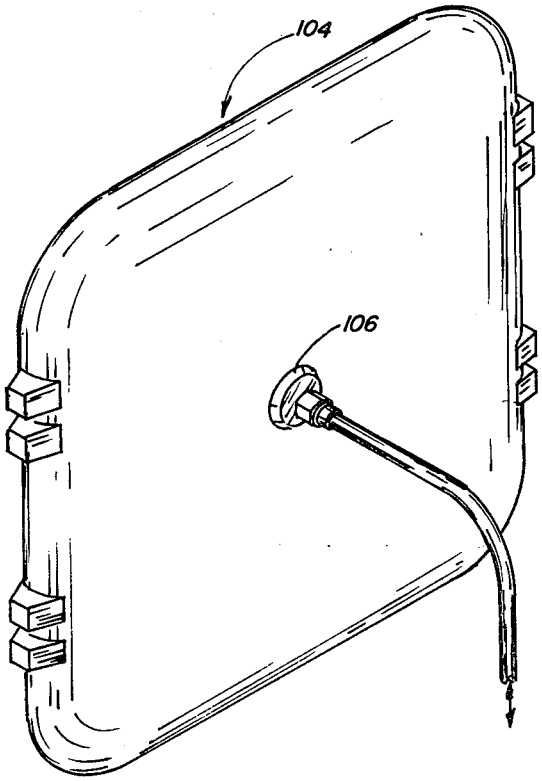
FIG. 13 is a perspective view of the hydraulic pad portion of the preferred embodiment of the apparatus of the present invention.

Tensile force applied by the pushing line system and more particularly by lines 28, 29 urges tug 12 into notch 25 abutting the bow 14 portion thereof towards surface 22. Side fender assemblies 100 face port 23 wing of barge 20 while side fender assemblies 102 face starboard 24 wing of barge 20. FIGS. 7 and 8 show more particularly the construction of side fender assemblies 100, 102. Each side fender assembly 100, 102 is positioned to bear and slide against provided corresponding bearing tower extensions 17, 18 (see FIG. 1A) of barge 20. Each side fender assembly 100, 102 can include a number of inflatable hydraulic pads 103 with between one and four pads being exemplary.

Figure 4:
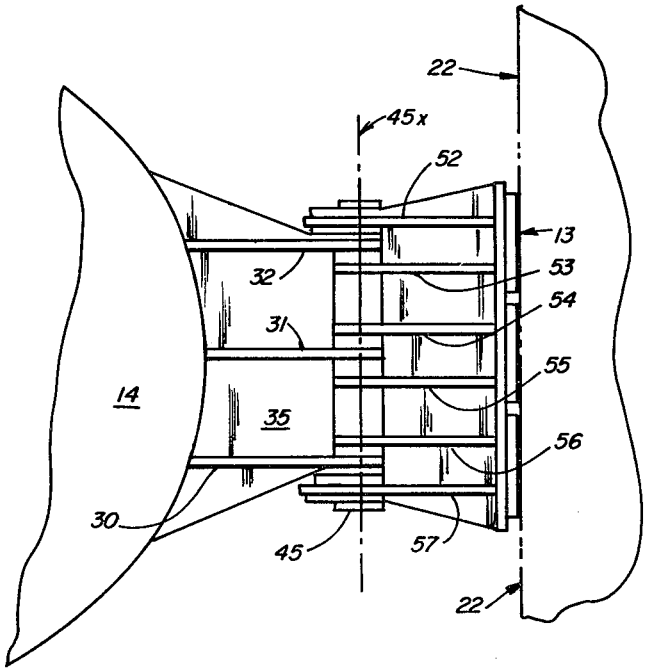
FIG. 4 is a partial plan view bow fender portion of the preferred embodiment of the apparatus of the present invention.

FIGS. 3 and 4 show more particularly the construction of bow fender 11. Bow fender 11 provides at least one generally vertical coupling plate 30 with three plates 30–32 being shown in the plan view of FIG. 2. Horizontal brackets 35, 36 are also seen. The forwardmost leading edge 37 of each vertical plate 30–32 provides upper and lower indentations 60, 62 for receiving resilient blocks (for example, rubber) 40, 42 as best seen in FIG. 3. The centralmost portion of vertical plates 30–32 project outwardly providing a projected 38 portion which contains opening 43 through which pin 45 is placed. The aforementioned vertical plates 30–32 and horizontal plates 35, 36 are rigidly connected to tug 12 at bow 14 defining a rigid section of bow fender 11. A movable, articulated section 50 of bow fender 11 is also provided which attaches to the rigid section (aforedescribed) portion of bow fender 11. The connection is formed by means of pin 45 with openings 43 being provided in each vertical plate 30–32 as well as the vertical plates 52–57 of articulated section 50 of bow fender 11. In similar fashion to the rigid section of fender 11, articulated section 50 likewise provides a plurality of horizontal brackets 58, 59. The construction of articulated section 50 of fender 11 can be of welded construction, for example, of structural steel or like suitable material. Each vertical plate 52–57 provides a similar profile to the profile as aforedescribed with regard to plates 30–32 of the rigid section. Indentations 60–62 are provided which receive blocks 40–42 as shown in FIG. 3. Likewise, a projected central portion 64 allows an opening 43 for the placement of pin 45 therethrough. When tug 12 pitches and heaves responsive to heavy seas, the tug position with respect to barge 20 will vary as shown by phantom lines in FIG. 3 indicating the varying positions of the tug bow 14 with respect to the hull of barge 12. This articulation produces extension and compression of blocks 40, 42 as the articulated section 50 rotates relative to the plate 30 through 32 around the pin 45 having a horizontal transverse axis **45*x***.

Figure 5:
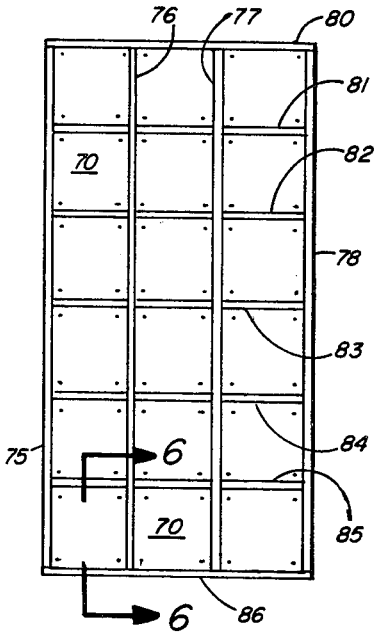
FIG. 5 is a front view of the bow fender portion of the preferred embodiment of the apparatus of the present invention.
Figure 6:
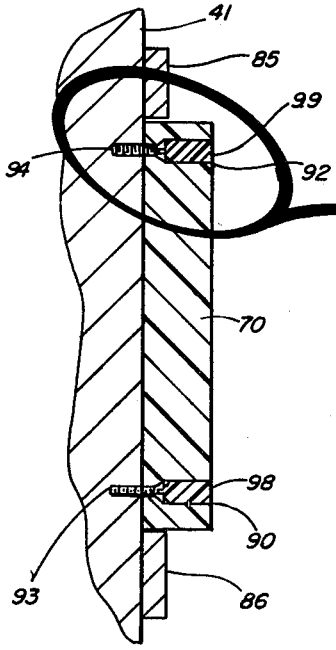
FIG. 6 is a sectional view taken along lines 6—6 of FIG. 5.
Figure 6A:
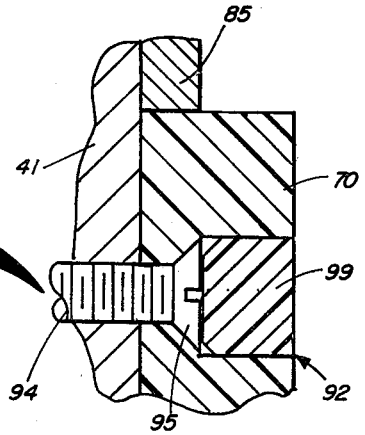
FIG. 6A is a fragmentary view of a portion of the bow fender of FIGS. 5–6.

The forward face 13 of bow fender 11 provides as best seen in FIG. 5 a matrix of blocks 70, each of which is depicted in section in FIG. 6. Blocks 70 can be, for example, of plastic or like material and can be square or rectangular being on the order of one foot square, for example. A plurality of vertical shear bars 80–86 and a plurality of horizontal shear bars 75–78 define borders about each pad 70. Openings 90–92 as shown in FIG. 6 provide means for insertion of anchor bolts 93–94 or the like to secure block 70 against surface plate 41 of fender 11. Surface plate 41 could be, for example, of structural steel or like material and would be welded, for example, to the plurality of vertical plates 52–57 and the plurality of horizontal plates 58–59 provided in FIGS. 3 and 4. Openings 90 could be of a depth which would allow the head 95 of each bolt 93–94 to be at roughly the same depth as the surface 97 of shear bars 80–86. Plugs 98, 99 of plastic material similar to the plastic material of pad 70 could be provided to thus give an overall continuous plastic surface to each block 70. Each plug 98, 99 would have a chamfer at its inner surface (see FIG. 6A). The chamfer would insure exposure of the bolts 93, 94 when excess wear occurs. When the bolt head 95 of any bolt 93, 94 appeared, it would mean to the visual inspector that the surface 72 of any particular block 70 had worn to a degree which required its replacement since at the time the surface 72 of pad 70 would coincide roughly with the surface 97 of the various shear bar 80–86 or 75–78.

On the port and starboard sides of tug 12 can be seen inflatable side fender assemblies 100, 102, each of which comprises one or more hydraulically inflatable pads 103. FIGS. 7–12 show more particularly the construction of each inflatable pad 103.

FIGS. 7–13 illustrate the side fender assembly 100, 102 portions of the preferred embodiment of the apparatus of the present invention. In FIG. 7, a side fender assembly is designated by the numeral 100, 102 representing the same assembly which could be used on both the port and starboard sides respectively of tug 12.

In FIG. 8, a sectional view illustrates an individual inflatable pad portion 103 of a side fender assembly with FIGS. 9–12 showing details of construction thereof.

Each side fender assembly 100, 102 includes, for example, one to four inflatable pads 103, each having a wear surface 101 which during operation bears against barge 20 at the inner surface of the notched portion thereof. Each side inflatable pad 103 is provided with a wear surface to bear and slide against which includes the inner wall of the barge notch 25 as well as a plurality of towers each having a respective inner surface directed inwardly and facing tug 12 and more particularly side fender assemblies 100, 102. Towers 17, 18 are vertically arranged, each providing a surface receptive of pads 103 and which allows vertical relative movement of tug 12 with respect to barge 20 and further allows each side fender assembly 100, 102 to move upwardly and downwardly responsive to pitching and heaving motion of the tug 12 and barge 20.

In FIG. 1A, wear surface 101 of pad 103 is shown in phantom lines, the arrows indicating schematically both extended upward and downward motion of the wear surface 101. The towers 17, 18 provide a vertical extension of barge 20 which provide the necessary wear surface above the deck of barge 20 when excess pitching and heaving of the tug and barge produces great vertical relative movement during operation.

In FIG. 8, a sectional view of an individual hydraulic pad 103 is shown. A suitable backup structure 125 would include, for example, a plurality of gusset plates 130 as well as a second plurality of gusset plates 131 placed at angles thereto, backed by plate 132.

140 indicates generally the hull line of the vessel, with 120 indicating the hull side shell portion of pad 103.

A rectangularly-shaped fairing 122 would surround the hydraulic pad 103 moving parts with the fairing 11 providing a generally beveled surface beginning at a point flush with tug hull 140 and gradually thickening to a position substantially coplanar with the fully compressed position of wear surface 101. Designated in FIG. 8 would be the normal working position of wear surface 101 as well as its maximum position. As will be described more fully hereinafter, these positions will be reached during operation at times responsive to the expansion and contraction of the inflatable pad bladder 104 portion of hydraulic pad 103, which responsive to pressurization causes pad cover assembly 105 to move away from hull side shell 120 and likewise responsive to contraction allows pad cover assembly 105 to return to a normal position. Hydraulic fluid would be provided through spigot 106 to inflatable pad 103 with hydraulic fluid being supplied thereto using an accumulator and a hydraulic system as more particularly explained in my prior U.S. Pat. No. 4,031,843, which is hereby incorporated by reference. A peripheral fairing wall 123 surrounds pad cover assembly 105 and inflatable pad 104.

FIGS. 9–12 show more particularly the construction of hydraulic pad cover 105. Pad cover 105 provides a generally rectangular configuration including cover plate 108 which is substantially square or rectangular in construction, and which is reinforced by a reinforcing shoulder 110. A peripheral side retaining wall 109 extends away from cover 108 in a direction normal thereto and provides a retainer for hydraulic pad bladder 104 during operation. A plurality of openings 107 are provided through cover 105 (and reinforcing shoulder 110) which will be occupied during operation by return springs 112 and studs 118.

Figure 10:
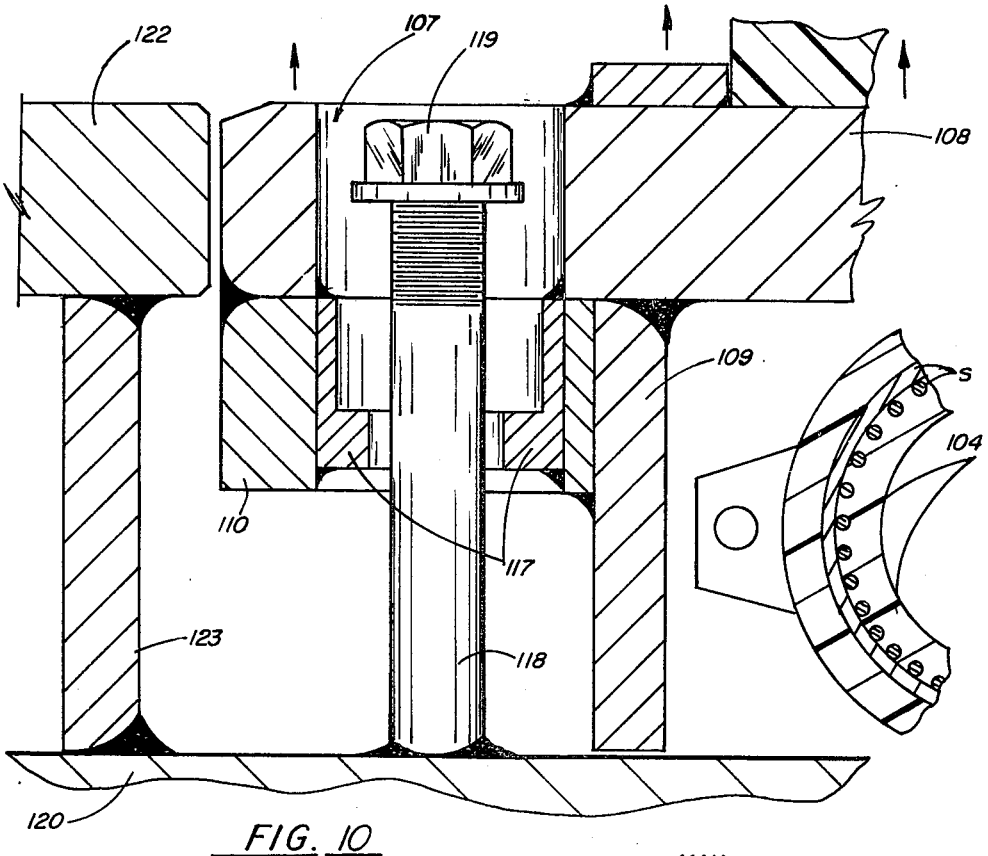
FIG. 10 is a partial sectional view of the hydraulic pad portion of the preferred embodiment of the apparatus of the present invention showing details of construction thereof.
Figure 11:
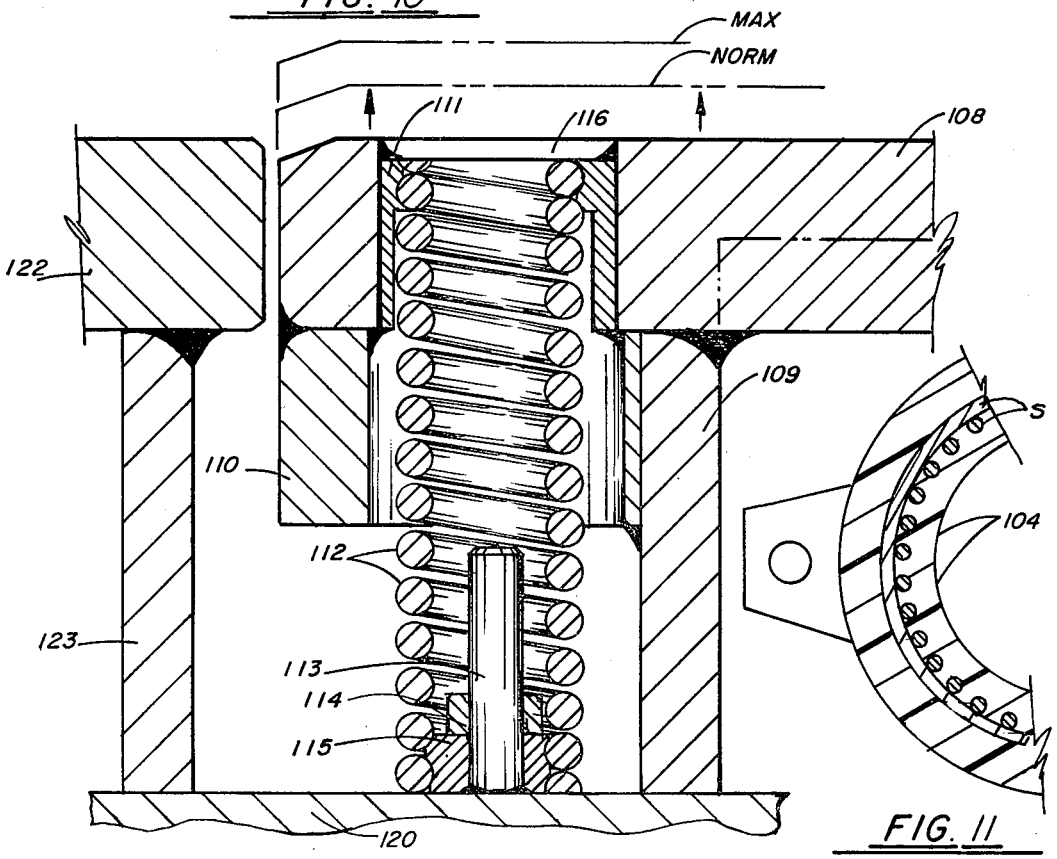
FIG. 11 is a partial sectional view of the hydraulic pad portion of the preferred embodiment of the apparatus of the present invention showing details of construction thereof

In FIGS. 10 and 11, the attachment of studs 118 to hull side shell 120 is shown as being welded, for example. Each stud 118 provides a nut 119 which could be, for example, threadably attached to stud 118 and affixed thereto. A cup 117 surrounds stud 118 and is placed generally within one of the openings 107 in pad cover assembly 105. A small opening is provided in cup 117 of a diameter slightly larger than the diameter of stud 118 so that stud 118 will pass therethrough. However, the opening is smaller than the outside diameter of nut 119 thus retaining pad cover 105 in position yet allowing it to move inwardly and outwardly responsive to inflation and deflation of inflatable pad 103.

In FIG. 11, return spring 112 is shown as being mounted upon spring retainer 115 which is secured to hull side shell 120 by nut 114 and stud 113. The nut 114 in conjunction with stud 113 allows a preloading of the spring to a predetermined force. A spring cup 111 is provided within opening 107 and spring cup stop 116 provides a stop for the connection of spring 112 to pad cover assembly 105. It will be understood by one skilled in the art from the above, that return springs 112 will normally hold and register pad cover assembly 105 and its attached working wear surface 101 in a normal working position as schematically illustrated in both FIGS. 10 and 11. The position of wear surface 101 can be expanded to a maximum allowed position responsive to the introduction of hydraulic fluid through spigot 106 and into hydralic pad 104. During neutral pressure within pad bladder 104, a retracted working position will be occupied as return springs 112 would normally index pad cover assembly 105 in that position. Pressurization forces the pad surface outwardly. During operation, force applied against wear surface 101 as, for example, when tug 12 and barge 20 are sailing transmitting force from barge 20 to working surface 101, a fully retracted position as shown in FIGS. 10 and 11 would be realized with side wall 109 abutting against hull side shell 120. An access opening 126 would be provided through a rearmost reinforcing plate 132 provided to backup structure 125 allowing the assembly of piping (see FIGS. 8, 18), for example, to spigot 106 for the introduction of hydraulic fluid to inflatable pad 104.

When the tug 12 enters in barge notch 25 all hydraulic pads 103 are deflated thus leaving a clearance of, for example, on the order of one inch between surface 101 of inflatable pad 103 and the corresponding wear surface of towers 105, 106 of barge 20. Once the tug 12 is fully in notch 25, the hydraulic pads 103 are inflated to a predetermined pressure and the clearance between bearing surfaces of the tug and barge are cancelled.

At sea, tug 12 and barge 20 are subject to hydrodynamic forces which more particularly tend to move tug 12 sideways and notch 25, and tug 12 is subject to roll relative to the barge. Hydraulic pads 103 have an internal pressure which varies according to the force and prevents the tug to sway, roll, and yaw relative to barge 20.

When tug 12 is to be disconnected from barge 20, pushing lines 28, 29 are castoff and hydraulic pads 103 are deflated by opening of a valve. Return springs 112 then force hydraulic pad cover 105 toward hull 140 thus building a clearance between tug 12 and barge 20. At that time the tug 12 can leave notch 25.

Hydraulic pad bladders 104 can be of a pliable, inflatable material such as rubber reinforced with steel S (FIGS. 10–11). Components of side fender assemblies 100, 102 can be manufactured of structural steel or the like.

A flat hydraulic cylinder could be used with a dynamic seal and/or in conjunction with an internal bladder to contain the hydraulic fluid avoiding the necessity to have a dynamic seal subject to wear and tear. A person skilled in the art could make a one piece assembly of the metallic hydraulic cylinder and the cover plate.

The steel reinforced bladder or hydraulic flat cylinder could be replaced with a closed-end bellows of, for example, metallic construction.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A barge and tug connection apparatus comprising:

a. a barge providing a V-notch portion for receiving a tug thereinto, the V-notch portion having a generally uniform horizontal section with its bottom open to the sea;

b. a tug for pushing the barge with the notch of uniform horizontal section allowing the tug to pitch and heave along its entire length within the notch relative to the barge;

c. a plurality of inflatable pad assemblies mounted on the tug, each comprising an outer housing having an outer movable wear surface positioned to bear and slide against the barge at sea and inner inflatable means for maintaining the wear surface in contact with the barge absent substantial clearance at sea;

d. pushing line means for maintaining the tug in the notched portion of the barge; and e. bow fender means mounted on the bow of the tug and facing the notch for longitudinally spacing the bow of the tug from the barge, the barge and the fender means each having smooth surfaces which can bear and slide against each other so that during normal operation the bow of the tug can freely pitch and heave responsive to wave action and with respect to different elevational positions of the barge.

2. The apparatus of claim 1 wherein the bow fender means provides in part a first coupling plate secured to the tug and a second coupling plate pivotally affixed to the first coupling plate and allowing relative movement therebetween.

3. The apparatus of claim 2 wherein the first and second plates are connected together at least in part by a pinned connection.

4. The apparatus of claim 1 wherein each of the inflatable pads provides an outer surface which is movable responsive to an increase or decrease in hydraulic volume within the pad.

5. The apparatus of claim 1 wherein the pushing line means comprises at least in part one elongated pushing line secured between the barge and the tug.

6. The apparatus of claim 1 wherein the pushing line means comprises at least in part one elongated elastic pushing line, the pushing line providing barge and tug end portions, the pushing line stretching during operation responsive to relative movement between the tug and the barge, and there is further provided pre-stressing means associated with the pushing line for pre-stressing the pushing lines.

7. The apparatus of claim 1 wherein each of the inflatable pads comprises at least in part a pliable bladder.

8. The appartus of claim 7 wherein said bladder is of a steel reinforced rubber material.

9. A barge and tug connection apparatus comprising:

a. a barge providing a V-notch portion for receiving a tug thereinto;

b. a tug for pushing the barge, with the notch portion being of generally uniform horizontal cross-section allowing the tug to pitch and heave in the notch relative to the barge;

c. port and starboard elongated elastic pushing lines, the pushing lines each providing barge and tug end portions connected during operation respectively to the barge and the tug, the pushing lines stretching during operation responsive to relative movement between the tug and the barge;

d. a bow fender mounted on the bow of said tug, and unattached to said barge, sliding thereagainst during operation, said fender comprising:

a first support member affixed to said tug, a second support member movably affixed to said first member;

a vertically disposed wear plate having a wear surface, said surface being positioned forwardly of said tug bow to bear and slide against said barge; and port and starboard hydraulically inflatable fender means for maintaining said wear surface in contact with said barge absent substantial clearance at sea.

10. The apparatus of claim 9 further comprising pre-stressing means associated with the pushing lines for pre-stressing each of the pushing lines uniformly along its length between the barge and the tug.

11. The apparatus of claim 7 wherein said port and starboard fender means are affixed to said tug.

12. The apparatus of claim 9 wherein each of the fender means comprises:

a collapsible hollow rubberized pad defining an inner fluid-containing space and having an opening for transmitting fluid thereinto, and a lateral support frame surrounding in part the pad.

13. The apparatus of claim 9 wherein the first and second support members are connected at least in part by a pinned connection.

14. The appartus of claim 9 wherein the vertically disposed wear plate provides a low friction bearing surface.

15. The apparatus of claim 9 wherein the port and starboard hydraulically inflatable fender means comprises:

an inflatable, rubberized hollow pad backing against the hull of the tug;

a cover plate placed atop the pad sandwiching the pad between the cover plate and the hull, the cover plate further comprising lateral means extending therefrom toward the hull for containing the pad in a lateral direction; and indexing means elastically connecting the hull and the cover plate for returning the cover plate to a neutral position absent presurization of the pad.

16. The apparatus of claim 15 further comprising a spigot penetrating the hollow pad and the hull of the tug and a source of hydraulic pressurized fluid connectable to the spigot.

17. The apparatus of claim 15 further comprising a rigid cover plate covering the hollow pad at the outermost surface thereof, and a plurality of indexing springs placed between the rigid cover plate and the hull of the tug for indexing the cover plate with respect to the hull when the hollow pad is unpressurized.

18. A barge-tug connection apparatus comprising:

a. a barge having a notch at its stern end, the notch being defined by providing inner walls of a pair of oppositely disposed spaced apart wing portions which meet at a rear facing apex, said apex extending from the barge deck area to the barge bottom area, the inner walls and apex being generally vertical and smooth;

b. a tug for pushing the barge, at least the forward bow portion of the tug occupying a position within the notch during operation;

c. an articulated bow fender assembly affixed to the tug bow, providing a first member rigidly affixed to the tug bow and a second member movably attached to the first member, the assembly further comprising a substantially flat vertical forward facing wear plate attached to the movable member and mounted generally perpendicular to the longitudinal axis of the tug, the wear plate positioned to bear and slide against the apex of the notch as the tug and barge change elevational positions, moving freely with respect to one another; and d. port and starboard side fender means for maintaining port and starboard wear surfaces in contact with the barge absent substantial clearance between the tug and barge at sea.

19. The apparatus of claim 18, wherein the port and starboard side fender means comprises in part a plurality of inflatable pads.

20. The barge-tug connection apparatus of claim 18 further comprising at least one resilient block disposed between the first and second members for absorbing compressive/tensile loads applied to the first and second members.

21. The barge-tug connection apparatus of claim 18, wherein the forward facing wear plate has a matrix of wear blocks affixed thereto.

* * * * *